US006884105B2

(12) United States Patent
Turck et al.

(10) Patent No.: US 6,884,105 B2
(45) Date of Patent: Apr. 26, 2005

(54) CONNECTOR WITH SNAP COLLAR LATCHING

(75) Inventors: Dietrich Reinhard Turck, Halver (DE); Werner Schmidt, Halver (DE)

(73) Assignees: Escha Bauelemente GmbH, Halver (DE); Lumberg Automation Components GmbH & Co. KG, Schalksmühle (DE)

( * ) Notice: Subject to any disclaimer, the term of this patent is extended or adjusted under 35 U.S.C. 154(b) by 0 days.

(21) Appl. No.: 10/735,611

(22) Filed: Dec. 12, 2003

(65) Prior Publication Data

US 2004/0198089 A1 Oct. 7, 2004

(30) Foreign Application Priority Data

Jan. 10, 2003 (DE) ..... 203 00 326 U

(51) Int. Cl.[7] ..... H01R 13/627
(52) U.S. Cl. ..... 439/352
(58) Field of Search ..... 439/352, 353, 439/357, 358

(56) References Cited

U.S. PATENT DOCUMENTS 6,497,516 B1 * 12/2002 Toyooka et al. ..... 385/78
6,568,950 B2 * 5/2003 Rudoy et al. ..... 439/352
6,688,907 B2 * 2/2004 Yamaoka et al. ..... 439/489
6,692,286 B1 * 2/2004 De Cet ..... 439/352

FOREIGN PATENT DOCUMENTS

DE 10235675 5/2003

* cited by examiner

*Primary Examiner*—Khiem Nguyen
(74) *Attorney, Agent, or Firm*—Martin A. Farber

(57) ABSTRACT

Connector (1) for fitting onto a counter connector (2), has a core portion (4) with a contact (3) for inserting into a sleeve (7) of the counter connector (2). The sleeve is provided with a latching step (5), and has a counter contact (6). The core portion is surrounded at a radial spacing by a collar (8), which has a latching first bead (9) for engaging over the latching step. The collar is surrounded in turn by a locking coupling (10), which in a release position allows slight radial displacement of the latching bead and in a locking position blocks the radial displacement. There is an axial continuation (11) of the collar which can escape axially in the release position and is blocked from escaping in the locking position. The continuation has a radially inner latching second bead (12).

6 Claims, 3 Drawing Sheets

1
19
10
4
5
3
9
11
12
6
7
2
5
18
9
8
15
11
14
12
16
17

CONNECTOR WITH SNAP COLLAR LATCHING

FIELD AND BACKGROUND OF THE INVENTION

The invention relates to a connector for fitting onto a counter connector, with a core portion having contact means for inserting into a sleeve of the counter connector, which sleeve is provided with a latching step and has counter contact means, the core portion being surrounded at a radial spacing by a collar, which has a latching bead for engaging over the latching step, which collar is surrounded in turn by a locking coupling, which in a release position allows slight radial displacement of the latching bead and in a locking position blocks the radial displacement.

DE 102 35 675 is concerned with a connector of this type with a snap collar. The connector serves for fitting onto a counter connector, the sleeve of which may have an external thread. The edge of the sleeve of the counter connector is provided with a peripheral step. To the rear of the step there is a groove. The latching bead of the collar can snap into this groove. For this purpose, the latching bead or the collar carrying the latching bead is made of soft plastic, so that the annular latching bead can be pushed over the latching step with concomitant elastic expansion. In order to fix the latching bead in this latching position, the locking coupling arranged displaceably on the connector has a radially inwardly directed step in the form of an annular projection. In the locking position, this step lies outwardly over the latching bead, so that its ability to escape radially is blocked. In the release position, the step is set back axially, so that radially outward of the latching bead there comes to lie a clearance into which the portion of the sleeve having the latching bead can radially escape. As a consequence of this setup, the pulling-off forces are significantly greater in the locking position than in the release position.

SUMMARY OF THE INVENTION

It is an object of the invention to develop the previously described connector in a way enhancing its functional features, in particular to increase the pulling-off force in the locking position.

In accordance with the invention, a second bead is formed radially on the inside of an axial continuation of the collar. In the release position, the axial continuation can escape radially. In the locking position, the axial continuation is blocked from escaping. In a development of the invention, it is proposed that the continuation comprises two tongues lying diametrically opposite each other and separated from each other by a gap. Each tongue may in this case have an associated second latching bead. The latching bead may be disposed at the free end of the continuation. Furthermore, the latching bead may lie on an imaginary helical curve. This configuration is particularly advantageous whenever the sleeve of the counter connector carries an external thread. The second latching bead can then engage in the turns of the external thread. On the outer side from the second annular bead, the continuation may have a thickening. This thickening is preferably of such a thickness that a portion of the locking coupling lies in physical contact with the thickening in the locking position. As a result, the locking coupling, which consists in particular of metal, prevents radial escape of the tongues, which consist in particular of soft plastic. Only in the release position of the locking coupling can the portion of the continuation carrying the second bead escape radially. In the locking position, the end edge of the locking coupling can be flush with the end edge of the continuation. In the release position, on the other hand, the end edge of the locking coupling assumes a position at a distance from the end edge of the continuation. During the displacement from the locking position into the release position, the locking coupling is drawn back with respect to the end edge of the continuation. As in the case of the prior art cited at the beginning, the locking coupling can be displaced back and forth between two latching positions. With regard to the configuration of the latching connection between the locking coupling and the connector part, reference is made to the constructions of DE 102 35 675.0. The connector there has a hard plastic portion which has on the outer wall two kidney-shaped depressions lying diametrically opposite each other. Radially inwardly directed latching continuations of the locking coupling engage in these kidney-shaped depressions. As a consequence of this engagement, this locking coupling cannot be displaced between two latching positions spaced axially apart from each other and cannot be turned.

BRIEF DESCRIPTION OF THE DRAWINGS

An exemplary embodiment of the invention is explained below on the basis of the accompanying drawings, in which.

DESCRIPTION OF THE PREFERRED EMBODIMENT

Figure 1:
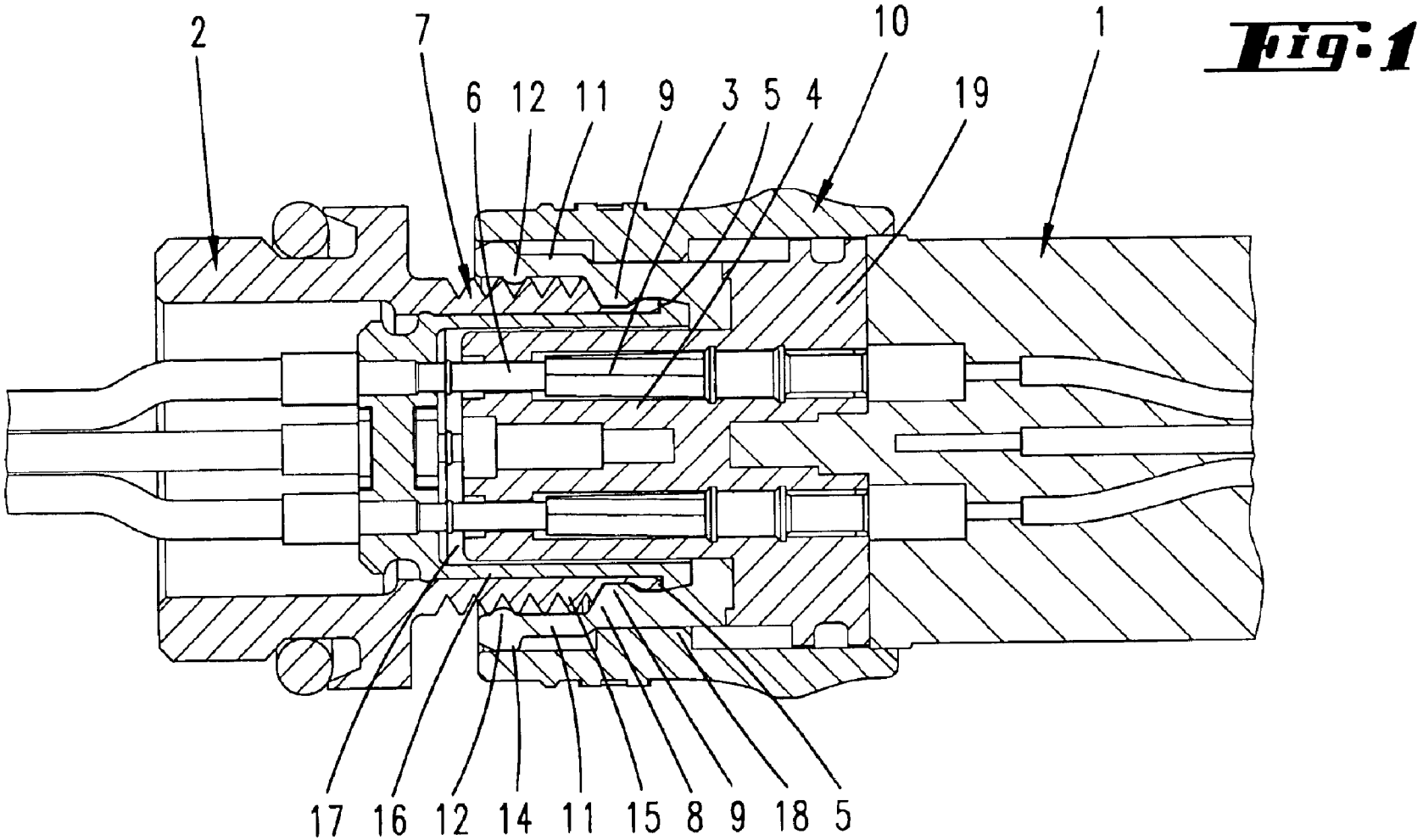
FIG. 1 shows in longitudinal section a connector connected to a counter connector, with the locking coupling brought into the locking position.

In the case of the connector 1, which is represented in the exemplary embodiment, the contact means 3 are configured in the form of sleeves. The associated counter contact means 6 of the counter connector 2 are formed in the case of the exemplary embodiment as pins which are pushed into the sleeves 3. Generally, connectors of this type are referred to as couplings. The invention also comprises those connectors in which the contact means 3 are formed by pins and the counter contact means of the counter connector are formed by sleeves. In the case of the exemplary embodiment, the core portion 4, which receives the contact means 3, is consequently formed as a hard plastic socket. This socket 4 is connected integrally to a hard plastic portion 19, which is overmolded with a soft plastic. In the case of the variant not represented, an insert opening in which pins are disposed may be provided instead of the socket.

The core portion 4 is inserted into a sleeve 7 of the counter connector 2. The sleeve 7 consists of two materials. The outer wall of the sleeve is formed by a threaded portion 15. The thread of the threaded portion 15 extends over a subregion of the outer wall of the sleeve 7. The inner wall of the sleeve 7 is formed by a plastic lining 16, which is connected integrally to the base of the sleeve opening, from which the counter contact means 6 protrude. The lining 16 also protrudes beyond the end edge of the threaded portion 15 and, with its end edge, forms together with the end edge of the threaded portion 15 a radially projecting latching step 5.

The core portion 4 of the connector 1 is surrounded by a collar 8 produced from soft plastic. The collar 8 has an annular latching bead 9 on the inner wall. The latching bead is made to match the latching step 5 in such a way that, in the coupled state, it grips behind the latching step 5 and consequently lies in a groove which lies to the rear of the latching step 5 and is adjoined by the external thread of the threaded portion 15.

Figure 3:
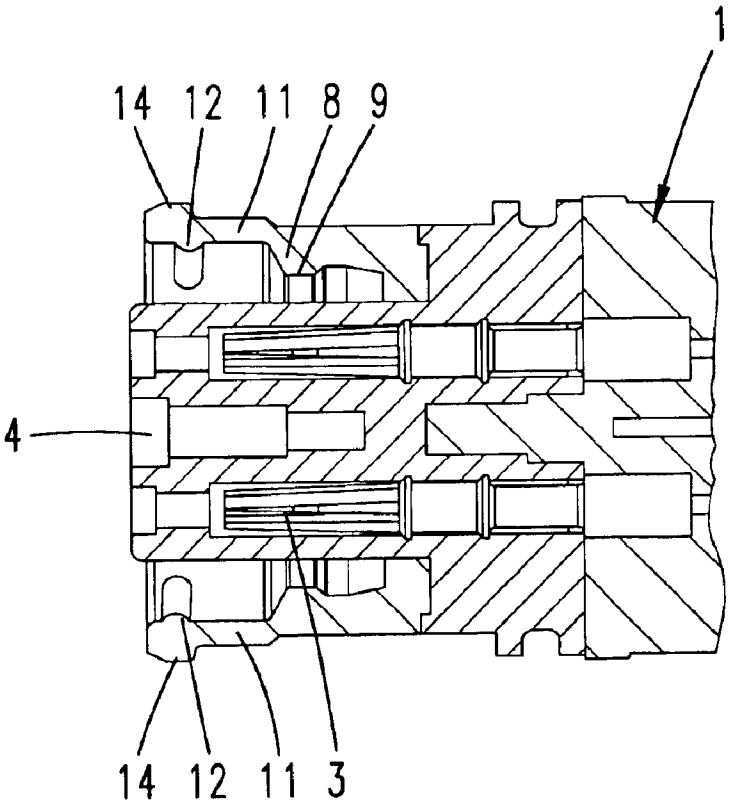
FIG. 3 shows a representation of the connector in longitudinal section with the locking coupling removed.

The latching bead 9 is adjoined by two tongues lying opposite each other and forming a continuation 11. The tongues 11 have outer edges 11', so that an axial slit (gap) 13 is formed between the outer edges 11' of the two tongues 11. Two slits 13 lying diametrically opposite each other are formed. As a result, the tongues 11 are able to escape radially, since they likewise consist of an elastic material. Latching beads 12 extend over an angular segment on the inner side of the tongues 11. In the exemplary embodiment, the latching beads 12 extend over an angle a of 80° over the radially inner side of the tongues 11. As is to be gathered in particular from figure 3, the latching beads 12 lie on an imaginary helical curve. The pitch of the helical curve corresponds to the pitch of the thread of the threaded portion 15. The two beads lie in the region of the free end of the tongues 11. In this region, each tongue 11 has a radially outer thickening 14.

Figure 2:
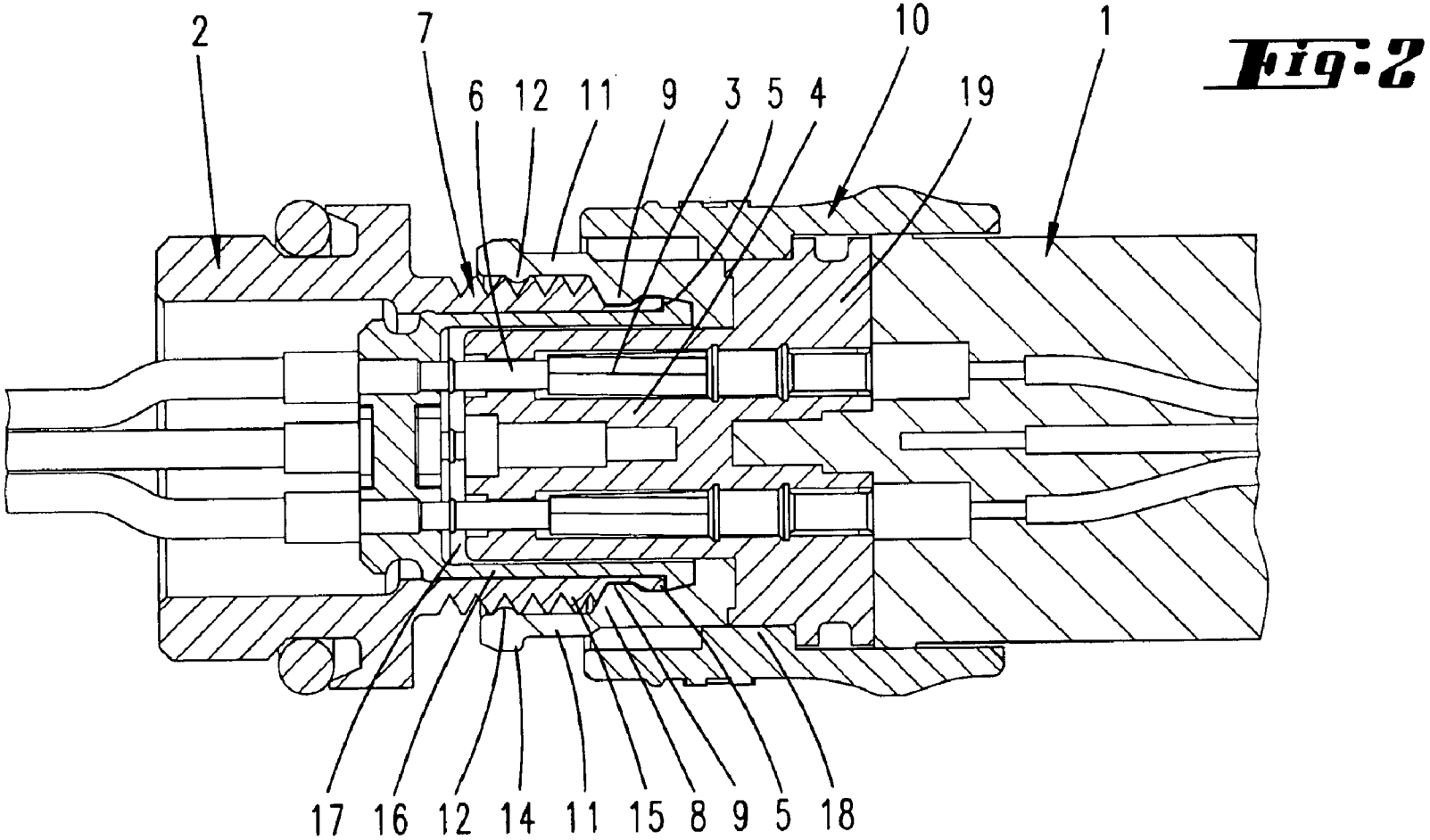
FIG. 2 shows the representation according to FIG. 1 with the locking coupling in the release position.
Figure 4:
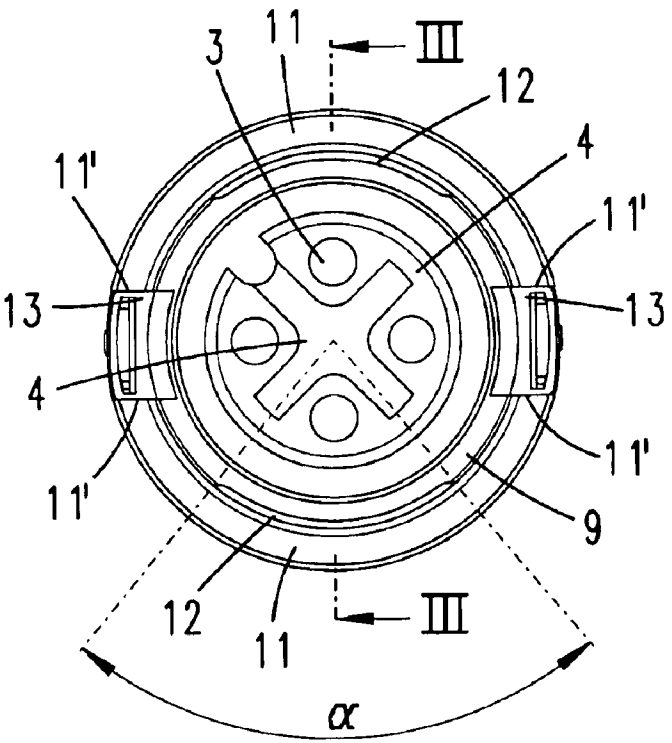
FIG. 4 shows a plan view of the end face of the connector represented in FIG. 3.

On the connector part, a locking coupling 10, represented in FIGS. 1 and 2, is mounted in an axially displaceable manner. The locking coupling 10 consists of metal and has a radially inwardly directed step 18, which rests with physical contact on the portion of the collar 8 on which the latching bead 9 is formed radially on the inside. In the locking position, the step 18 lies directly on the radially outer side of the latching bead 9, so that the ability of the bead to move radially outward is blocked. In this locking position, an inner portion at the end face of the locking coupling 10 is in physical contact with the previously mentioned thickening 14, so that this portion of the tongue 11, which has the latching bead 12 associated with it, cannot escape radially in the locking position. As a result, the two diametrically opposite latching beads 12 are held in their position in which they are lying in the turns of the thread.

By means of a latching continuation, which is not represented but engages in a kidney-shaped latching recess of a hard plastic portion 19 of the connector 1, the locking coupling 10 is held in a latching manner in the locking position. The latching projection, not represented, can be displaced in the axial direction in the kidney-shaped latching recess (likewise not represented), so that the locking coupling 10 can be displaced from the locking position represented in FIG. 1 into the release position represented in FIG. 2. In this release position, the step 18 lies away from the latching bead 9 in the axial direction. Radially outward from the latching bead 9 there is now a portion of increased diameter of the inner wall of the locking coupling 10. The portion of the collar 8 having the latching bead 9 can enter this free space if the connector 1 is to be pulled off from the counter connector 2. Since, in the release position represented in FIG. 2, the thickening 14 no longer has the inner wall of the locking coupling 10 engaging over it, the tongue 11 can escape radially, which has the consequence that the latching bead 12 leaves the turns of the thread.

In a development of the invention not represented, the previously described connector 1, which may also be a coupling, is coupled with a counter connector part 2, the sleeve 7 of which has no external thread but is substantially smooth-walled. At the level of the two diametrically opposite latching beads 12, this substantially smooth-walled sleeve has, however, two recesses. The recesses serve for the entry of the latching bead 12, so that dual latching is also ensured in the case of this exemplary embodiment.

Since the first latching bead 9 is disposed such that it is axially offset with respect to the second latching bead 12 and both latching beads 9, 12 have the same latching coupling 10 engaging over them in a manner blocking radial movement, the plug-in connection between the connector 1 and the counter connector 2 has great flexural rigidity.

In the case of the exemplary embodiment, the cross-sectional contour of the latching bead (12) has the form of a radius. It involves less than a half-circle. The radius is 0.4 mm with a pitch of 1 mm.

What is claimed is:

1. Connector (1) for fitting onto a counter connector (2), with a core portion (4) having contact means (3) for inserting into a sleeve (7) of the counter connector (2), which sleeve is provided with a latching step (5) and has counter contact means (6), the core portion (4) being surrounded at a radial spacing by a collar (8), which has a latching first bead (9) for engaging over the latching step (5), which collar (8) is surrounded in turn by a locking coupling (10), which in a release position allows slight radial displacement of the latching bead (9) and in a locking position blocks the radial displacement, wherein there is an axial continuation (11) of the collar (8) which can escape axially in the release position and is blocked from escaping in the locking position and has a radially inner latching second bead (12).

2. Connector according to claim 1, wherein the continuation (11) comprises two tongues lying diametrically opposite each other and separated from each other by a gap (13).

3. Connector according to claim 1, wherein a latching second bead (12) is associated with each of two tongues of the continuation (11).

4. Connector according to claim 1, wherein the latching second bead (12) is disposed at a free end of the continuation (11).

5. Connector according to claim 1, wherein the latching bead (12) lies on an imaginary helical curve.

6. Connector according to claim 1, wherein there is a thickening (14) on the outside of the continuation in the region of the second bead (12), the second bead being an annular bead.

* * * * *